United States Patent [19]

Delen et al.

[11] 4,144,475

[45] Mar. 13, 1979

[54] GAS AND/OR VAPOR DISCHARGE LAMP

[75] Inventors: Robert R. M. Delen; Duido J. J. Lenaerts, both of Eindhoven, Netherlands

[73] Assignee: U.S. Philips Corporation, New York, N.Y.

[21] Appl. No.: 879,479

[22] Filed: Feb. 21, 1978

[30] Foreign Application Priority Data

Apr. 15, 1977 [NL] Netherlands ..... 7704134

[51] Int. Cl.[2] ..... H01J 61/52

[52] U.S. Cl. ..... 315/73; 313/25

[58] Field of Search ..... 313/25, 1; 315/73, 74, 315/362

[56] References Cited

FOREIGN PATENT DOCUMENTS 7611934 1/1977 Fed. Rep. of Germany.

*Primary Examiner*—Rudolph V. Rolinec
*Assistant Examiner*—Darwin R. Hostetter
*Attorney, Agent, or Firm*—313; Robert S. Smith

[57] ABSTRACT

The invention relates to high pressure sodium vapor discharge lamp comprising a discharge tube and an outer bulb enveloping this tube, a glow starter being disposed in the space between that discharge tube and the outer bulb.

In accordance with the invention the glow starter is resiliently clamped between the two rigid electric conductors which supply the discharge tube with current.

1 Claim, 2 Drawing Figures

GAS AND/OR VAPOR DISCHARGE LAMP

Figure 1:
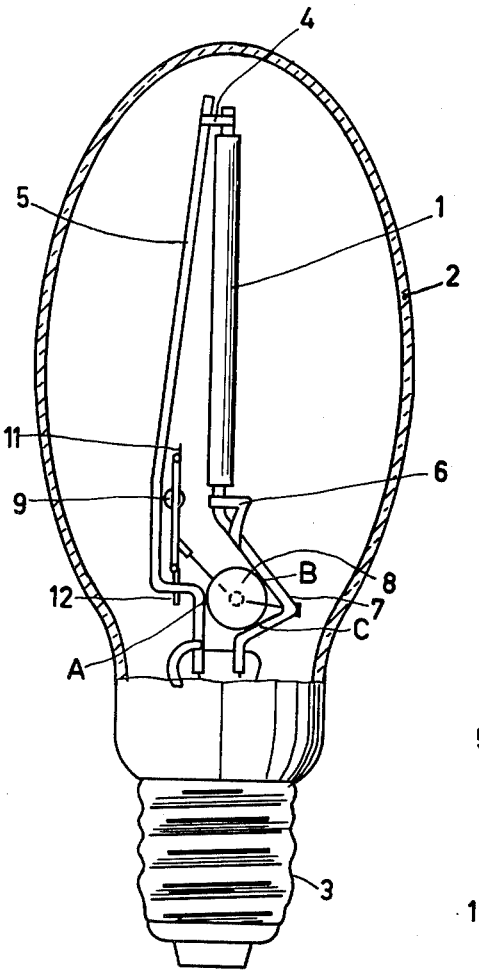

The invention relates to a gas and/or vapour discharge lamp comprising a discharge tube and an outer bulb enveloping this tube, the discharge tube being supplied with current through two stiff electric supply conductors, and an electric circuit component for operating the discharge tube being disposed in the space between the discharge tube and the outer bulb.

A known lamp of the type defined above is, for example, disclosed in German Gebrauchsmuster No. 7611934.

With that known lamp the electric circuit component — in the space between the discharge tube and the outer bulb — is a glow starter. A disadvantage of that known lamp is that the glow starter is insufficiently locked against movement relative to the other lamp parts. Consequently, in the case of mechanical shocks or vibrations the leads of this glow starter can easily break or the glow starter can damage other parts of the lamp.

It is an object of the invention to provide a gas and/or vapour discharge lamp of the type defined above wherein that electric circuit component is locked in an improved manner against displacement within the lamp.

According to the invention, a gas and/or vapour discharge lamp comprising a discharge tube and an outer bulb enveloping this tube, the discharge tube being supplied with current through two stiff electric supply conductors, and an electric circuit component for operating the discharge tube being disposed in the space between the discharge tube and the outer bulb, is characterized in that the electric circuit component is clamped between the two stiff supply conductors.

An advantage of a lamp according to the invention is that the electric circuit component — in the space between the discharge tube and the outer bulb — can substantially not be displaced. In a lamp according to the invention it is furthermore simple to secure the electric circuit component by jamming it between the two supply conductors. The two supply conductors of the discharge tube perform a double function, namely that of supplying current to the discharge tube and that of mechanically securing the electric circuit component.

The electric circuit component may, for example, be a capacitor, for example a radio interference suppressing capacitor or a capacitor for improving the working factor (cosine $\phi$) of the lamp.

In an embodiment of a gas and/or vapour discharge tube according to the invention the electric circuit component is a glow starter. An advantage of this embodiment is that the required voltage to be supplied to the electric connecting elements of the lamp for igniting the lamp can be relatively low since the required high starting voltage is produced by means of the glow starter — which is disposed inside the outer bulb — for starting a discharge in the discharge tube. To that end the glow starter — at least during the starting procedure — is connected as a rule in parallel across the discharge tube.

In another embodiment of a gas and/or vapour discharge lamp according to the invention, at least one of the supply conductors has a bend in the region of the electric circuit component, and whereby that supply conductor bears against the electric circuit component on either side of that bend. An advantage of this preferred embodiment is that the electric circuit component can be secured very reliably in this manner.

Figure 2:
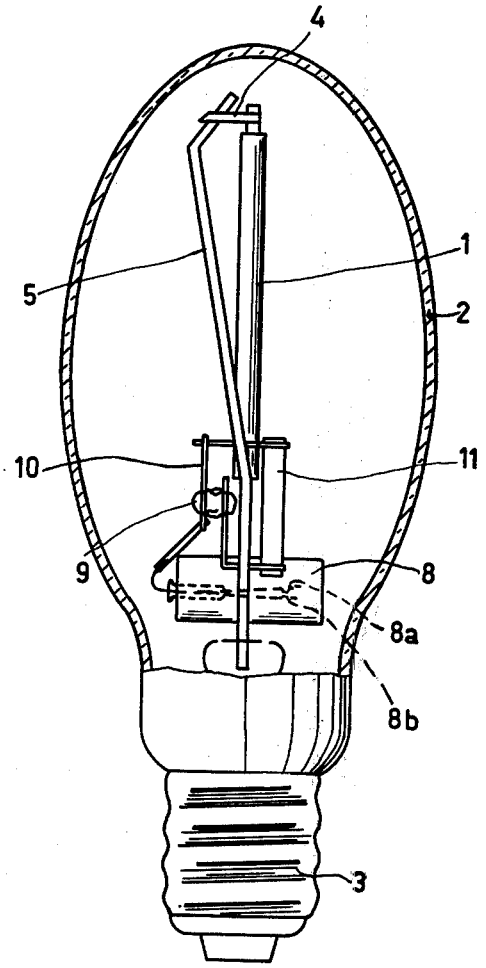

An embodiment according to the invention will now be explained with reference to a drawing in which:

FIG. 1 shows a view, with a partly cutaway outer bulb, of a discharge lamp according to the invention; and FIG. 2 shows a similar view of the lamp of FIG. 1, however after rotation of the lamp through 90° about its longitudinal axis.

The lamp shown in FIG. 1 is a high-pressure sodium vapour discharge lamp of approximately 70 Watt. Reference 1 indicates a discharge tube, which is enveloped by an outer bulb 2 which has an elliptical form. Reference 3 indicates a base of the lamp. The end of the discharge tube 1 which faces away from the lamp base 3 is connected through a metal strip 4 to a stiff supply conductor 5. This supply conductor 5 leads to a connecting element of the lamp base 3. The other end of the discharge tube 1 is connected, also through a metal strip 6, to a stiff supply conductor 7. This supply conductor 7 leads to another connecting element of the lamp base 3. Reference 8 indicates a glow starter provided with a glass envelope.

Said glow starter 8 is clamped between the stiff supply conductors 5 and 7 by forming the starter between them. The glow starter 8 engages the supply conductor 5 at A. The glow starter 8 engages the supply conductor 7 in two places, namely at B and at C. The supply conductor 7 has a bend between B and C. Accordingly, with this manner of clamping, the glow starter is wedged in the V-shaped portion of the supply conductor 7. Two electrodes 8*a* and 8*b* are disposed in the glow starter, at least one of which is a bimetal electrode. The filling gas of the glow starter consists of a mixture of gases, namely approximately 93% Helium, 5% Hydrogen and 2% Argon. One electrode of the glow starter 8 is electrically connected to the stiff supply conductor 7. The other electrode is connected — through an electric conductor 10 which is supported by a glass bead 9 — to a bimetal switch 11 located adjacent the glow starter. The other side of that bimetal switch is connected via a conductor 12 to the stiff supply conductor 5.

In the non-started state of the lamp the bimetal switch 11 is closed, that is to say the glow starter 8 is then electrically in parallel with the discharge tube 1.

The described lamp is connected, for example through an inductive stabilisation impedance of approximately 0.6 Henry to an a.c. power supply of approximately 220 volts, 50 Hz. If the connection to the a.c. power supply is effected, a glow discharge will first be produced in the glow starter 8. If the heat generated by this glow discharge has caused a deformation of the bimetal electrode in the glow starter so that the electrodes of the glow starter contact one another the glow discharge will extinguish and a current of a higher intensity will start flowing through the stabilisation ballast. If thereafter the glow starter electrodes cool and disengage again, this current will be abruptly interrupted; which will result in a voltage peak between the electrodes of the discharge tube 1. Then the discharge in this tube is ignited. Should this not happen the first time, then the starting procedure as described above will be repeated. If the discharge in the tube 1 has started, the voltage between the electrodes of that tube — after a rise period — will attain the operating voltage which amounts to approximately 90 Volts. This value is below the value of the starting voltage of the glow starter 8. This means that the glow starter 8 remains in the extinguished state. However, the bimetal switch 10 is present by way of additional safety device. This switch opens the connection between the glow starter and the supply conductor 5 if this bimetal switch 10 has been properly heated owing to the heat produced in the discharge tube 1 in the operating condition of the lamp.

In a practical embodiment the length of the lamp shown is approximately 15 cm and the greatest diameter of the outer bulb 2 is approximately 7 cm.

Components in FIG. 2 which correspond with the components shown in FIG. 1 have been given the same reference numerals. The Figures show that the glow starter 8 contacts the stiff supply conductors by means of its cylindrical envelope. The shape of the stiff supply conductor 5 — near the end of the discharge tube 1 which faces away from the lamp base 3 — has been chosen such that no unpleasant shadow effects are produced on an object to be illuminated with this lamp, for example a road surface.

The glow starter 8 in the described lamp can no longer move in the lamp owing to said clamping between the stiff supply conductors. This increases the life of this lamp. Instead of a glow starter, an alternative component such as a capacitor may be held in the lamp between the clamping conductors in the same manner as described for the glow starter.

What is claimed is:

1. A gas and/or vapour discharge lamp comprising a discharge tube and an outer bulb enveloping said tube in spaced relationship, two stiff electric supply conductors supplying current to said discharge tube, an electric circuit component for operating said discharge tube being disposed in the space between said discharge tube and said outer bulb, said electric circuit component being clamped between said two stiff supply conductors, said electric circuit component being a glow starter, at least one of said supply conductors having a bend in the region of said electric circuit component, said one supply conductor bearing against said electric circuit component on both converging sides of said bend.

* * * * *